US010020604B2

(12) United States Patent
Vo et al.

(10) Patent No.: US 10,020,604 B2
(45) **Date of Patent: *Jul. 10, 2018**

(54) CONNECTION DEVICE FOR ELECTRICAL CONNECTION OF AN ELECTRICAL LOAD WITH A SOURCE OF ELECTRICAL POWER

(71) Applicant: EATON CORPORATION, Cleveland, OH (US)

(72) Inventors: Dai Vo, McDonough, GA (US); Erik Jeffrey Gouhl, Fayetteville, GA (US); Robin Lu, Dongguan (CN)

(73) Assignee: EATON INTELLIGENT POWER LIMITED, Dublin 4 (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/392,555

(22) Filed: Dec. 28, 2016

(65) Prior Publication Data

US 2017/0214164 A1 Jul. 27, 2017

Related U.S. Application Data

(63) Continuation of application No. 15/002,647, filed on Jan. 21, 2016, now Pat. No. 9,583,864.

(51) Int. Cl.

| | |
|---|---|
| ***H01R 13/02*** | (2006.01) |
| ***H01R 13/512*** | (2006.01) |
| ***H01R 13/62*** | (2006.01) |

(52) U.S. Cl.

CPC ..... *H01R 13/02* (2013.01); *H01R 13/512* (2013.01); *H01R 13/62* (2013.01)

(58) Field of Classification Search

CPC ..... H01R 13/02; H01R 13/62; H01R 13/512; H01R 13/502

USPC ..... 439/470

See application file for complete search history.

(56) References Cited

U.S. PATENT DOCUMENTS

| | | | | |
|---|---|---|---|---|
| 7,063,556 | B1 * | 6/2006 | Wong | H01R 4/2408 439/411 |
| 7,101,226 | B1 * | 9/2006 | Gilliland | H01R 13/652 439/146 |
| 7,431,605 | B2 * | 10/2008 | Dieterle | H01R 13/6272 439/358 |
| 7,435,112 | B1 * | 10/2008 | Miller | H01R 13/502 439/133 |
| 7,479,044 | B1 * | 1/2009 | MacCrindle | H01R 13/426 439/699.2 |
| 7,614,897 | B2 * | 11/2009 | Lopez | H01R 13/516 439/248 |

(Continued)

*Primary Examiner* — Harshad C Patel

(74) *Attorney, Agent, or Firm* — Eckert Seamans

(57) ABSTRACT

A connection device employs a plurality of housing portions that are formed separately from one another and further includes a plurality of conductors. The plurality of conductors are situated on a first housing portion, and a second housing portion and a third housing portion are then affixed at opposite ends of the first housing portion to retain the conductors in place on the first housing portion. The first, second, and third housing portions, being connected together, are then received in a receptacle of a fourth housing portion to form the connection device. The conductors each have an elongated shank that is received in an elongated channel formed in the first housing portion before the second and third housing portions are attached thereto.

12 Claims, 6 Drawing Sheets

(56) References Cited

U.S. PATENT DOCUMENTS

| | | | | |
|---|---|---|---|---|
| 8,093,511 | B2 * | 1/2012 | Ljungren | H02G 3/20 174/491 |
| 8,674,245 | B2 * | 3/2014 | Komatsu | B60N 2/0228 200/18 |
| 8,888,535 | B2 * | 11/2014 | Knight | H01R 13/5221 439/650 |
| 9,484,667 | B2 * | 11/2016 | Ichio | B60L 11/1818 |
| 9,583,864 | B1 * | 2/2017 | Vo | H01R 13/5825 |
| 2005/0032414 | A1 * | 2/2005 | Hoch | H01R 9/032 439/470 |
| 2012/0295460 | A1 * | 11/2012 | Ichio | H01R 13/5208 439/205 |
| 2015/0179372 | A1 | 6/2015 | Gouhl | |

* cited by examiner

CONNECTION DEVICE FOR ELECTRICAL CONNECTION OF AN ELECTRICAL LOAD WITH A SOURCE OF ELECTRICAL POWER

CROSS REFERENCE TO RELATED APPLICATION

The instant application claims priority from U.S. patent application Ser. No. 15/002,647 filed Jan. 21, 2016, the disclosures of which are incorporated herein by reference.

BACKGROUND

Field

The disclosed and claimed concept relates generally to electrical equipment and, more particularly, to an electrical connector.

Related Art

Numerous types of electrical connection devices are known in the relevant art. One example of a known connection device is of a type that is situated at the end of a power cord and that is connectable with a wall outlet or other connector that is connected with a source of electrical power. By plugging the connection device into the connector, the electrical load that is connected with the power cord is provided with a supply of electricity in order to operate in its intended fashion. While such connection devices have been generally effective for their intended purposes, they have not been without limitation.

Depending upon the particular electrical application and the relevant environment, and also depending upon legacy factors, some connection devices have been difficult to manufacture because of the positions of the electrical conductors with respect to one another on the connection device that may be required. In some situations, the conductors have been such that the connection device was capable of manufacture only in specific fashions. One such fashion was to hold the conductors in a particular orientation on some type of a support and to mold in situ about the conductors the polymeric material that forms the insulative portions of the connection device. Such manufacturing processes have been subject to variability due to the molded nature of the polymeric material and the fact that the polymeric material is molded in situ around the contacts. Such previously known connection devices have often required extra work for cleanup and have also had an undesirably high scrap rate. Improvements thus would be desirable.

SUMMARY

Accordingly, an improved connection device employs a plurality of housing portions that are formed separately from one another and further includes a plurality of conductors. The plurality of conductors are situated on a first housing portion, and a second housing portion and a third housing portion are then affixed at opposite ends of the first housing portion to retain the conductors in place on the first housing portion. The first, second, and third housing portions, being connected together, are then received in a receptacle of a fourth housing portion to form the connection device. The conductors each have an elongated shank that is received in an elongated channel formed in the first housing portion before the second and third housing portions are attached thereto.

Accordingly, an aspect of the disclosed and claimed concept is to provide an improved connection device having a plurality of separately formed housing portions and a plurality of conductors, with the conductors being attached to a first housing portion, and with one or more separate housing portions being attached together or to the first housing portion in order to retain the conductors in place.

As such, an aspect of the disclosed and claimed concept is to provide an improved connection device structured to be electrically connected with an electrical load and further structured to be electrically connected with a connector that includes a source of electrical power. The connection device can be generally stated as including a housing that can be generally stated as including a first housing portion and a second housing portion that are separate from one another, the first housing portion having an elongated channel formed therein, the second housing portion can be generally stated as including a stem and a cap, at least a portion of the stem being received in the channel, the cap being situated adjacent an end of the first housing portion, an electrical apparatus situated on the housing and that can be generally stated as including a plurality of conductors, each conductor of the plurality of conductors can be generally stated as including an elongated shank, a contact situated at a first end of the shank that is electrically connectable with the connector, and a terminal situated at a second end of the shank that is electrically connectable with the electrical load, at a least portion of each shank being situated in the channel and being disposed between the stem and the first housing portion, and a number of mounts, at least a first mount of the number of mounts can be generally stated as including a pair of confronting retention surfaces situated on one of the housing and a conductor of the plurality of conductors and can be generally stated as further including a captive portion situated on the other of the housing and the conductor, the captive portion being received between the pair of confronting retention surfaces to resist movement of the conductor in a direction away from the stem, the at least first mount can be generally stated as further including a first engagement surface formed on the first housing portion and a second engagement surface formed on the second housing portion, a portion of the conductor being retained between the first and second engagement surfaces to resist movement of the conductor in a direction along the longitudinal extent of the channel.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
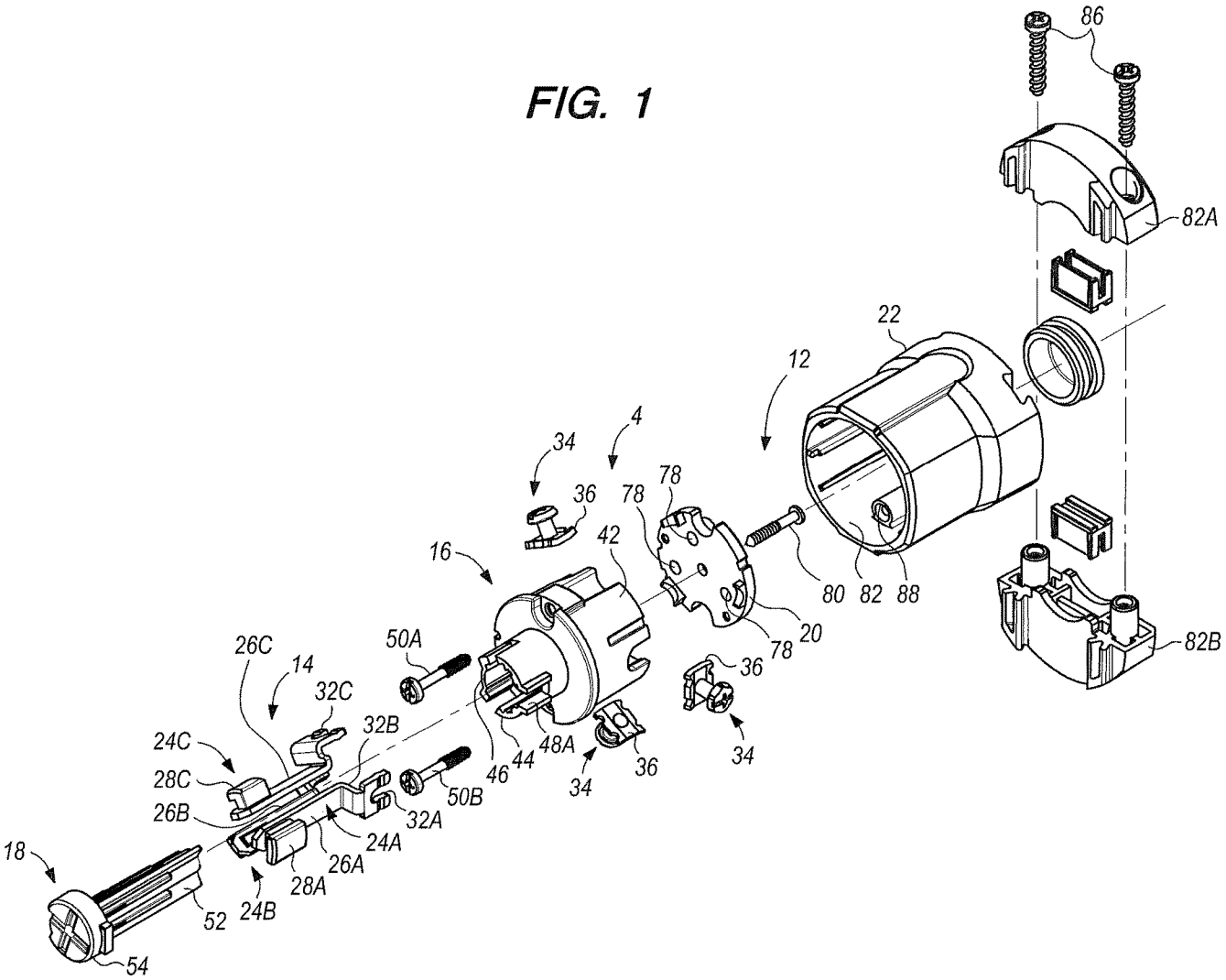
FIG. 1 is an exploded view of an improved connection device in accordance with the disclosed and claimed concept.
Figure 2:
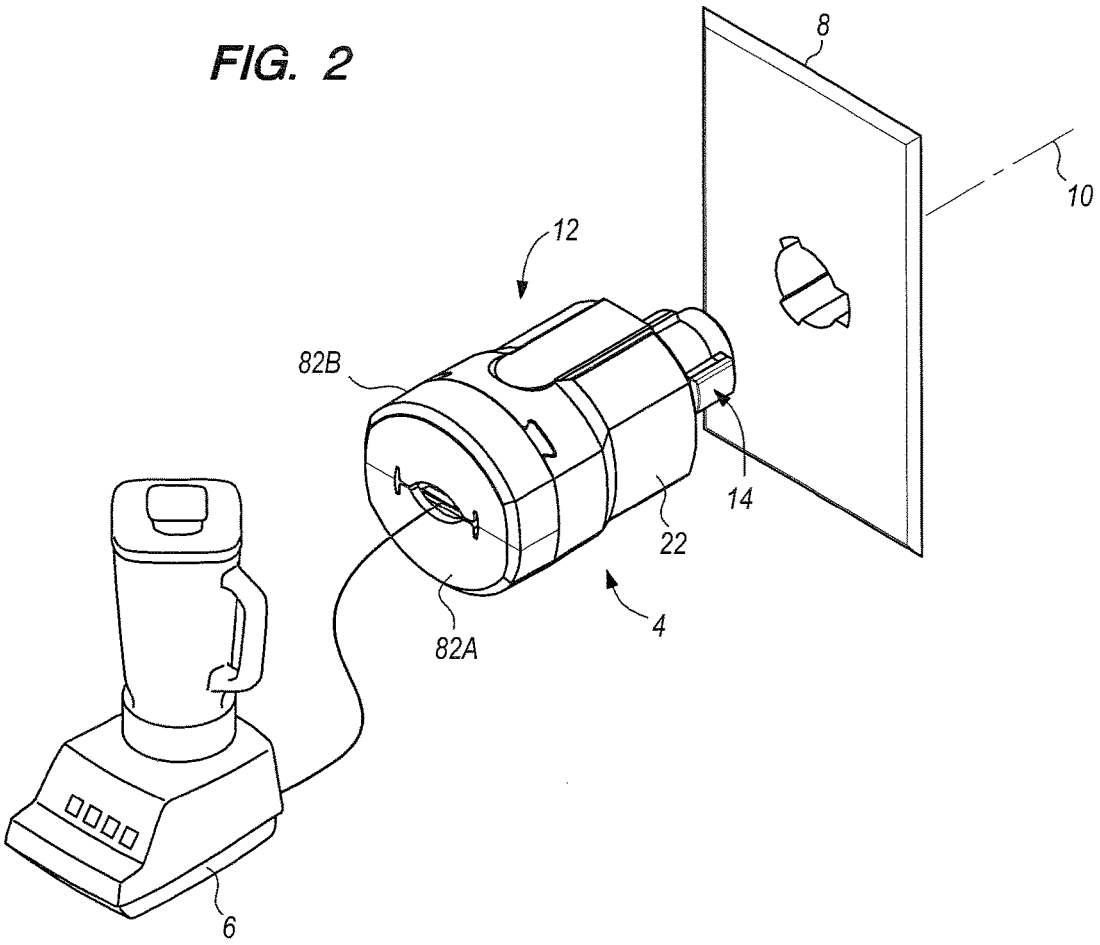
FIG. 2 is a depiction of the connection device of FIG. 1 connected with an electrical load and being connectable with a wall connector.
Figure 3:
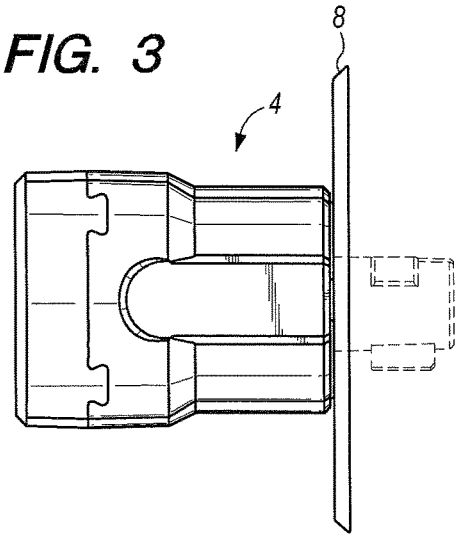
FIG. 3 is a side view of the connection device received in the wall connector of FIG. 2.

An improved connection device 4 is depicted in an exploded fashion in FIG. 1. As is depicted in FIGS. 2 and 3, the connection device 4 is connectable with an electrical load 6 and is connectable with a connector 8 that is connected with a source of electrical power 10. The exemplary connector 8 is depicted as being a wall connector having a socket within which a portion of the connection device 4 is receivable to electrically connect together the source of electrical power with the electrical load 6. The electrical load 6 is generically depicted herein and can be any appropriate electrical load without limitation.

As can be understood from FIG. 1, the connection device 4 can be generally stated to include a housing 12 and an electrical apparatus 14, with the electrical apparatus 14 being situated on the housing 12. As will be set forth in greater detail below, the connection device 4 is advantageously formed by having the various components of the housing 12 and the various components of the electrical apparatus 14 assembled together to form the connection device 4. This is to be contrasted with forming a housing via molding it in situ about an electrical apparatus. Rather the configuration of the housing 12 to include a plurality of separately formed components or portions that are assembled together overcomes shortcomings that have been known to exist with previous molded connection devices.

The housing 12 includes a plurality of separate components that are assembled together and which include a first housing portion 16, a second housing portion 18, a third housing portion 20, a fourth housing portion 22, and a set of compression elements 82A and 82. As can be understood from FIG. 1, the first, second, third, and fourth housing portions 16, 18, 20, and 22, and the compression elements 82A and 82B are formed separately from one another, such as by individually molding or otherwise forming each such part for subsequent assembly into the connection device 4. The various components of the housing 12 are formed of any of a variety of electrically insulative polymeric materials or other materials that are suited to use in an electrical environment as a part of an electrical device, such as one which is manually receivable in a socket of the connector 8 and thus is designed to withstand manipulation, dropping, being stepped upon, and the like.

Figure 8:
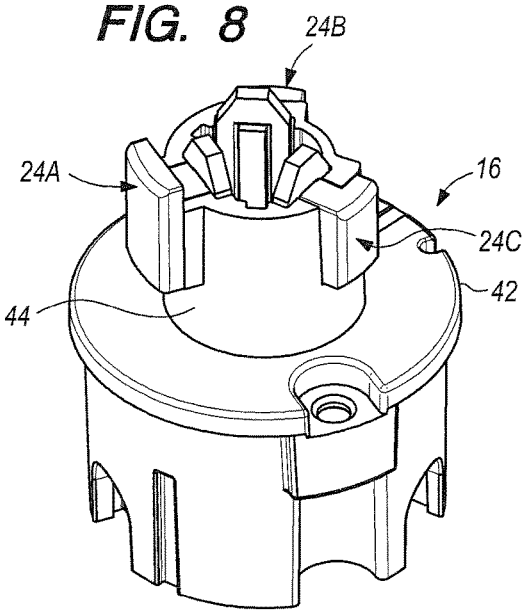
FIG. 8 is a view similar to FIGS. 4 and 6, except depicting three conductors situated on the first housing portion.
Figure 8A:
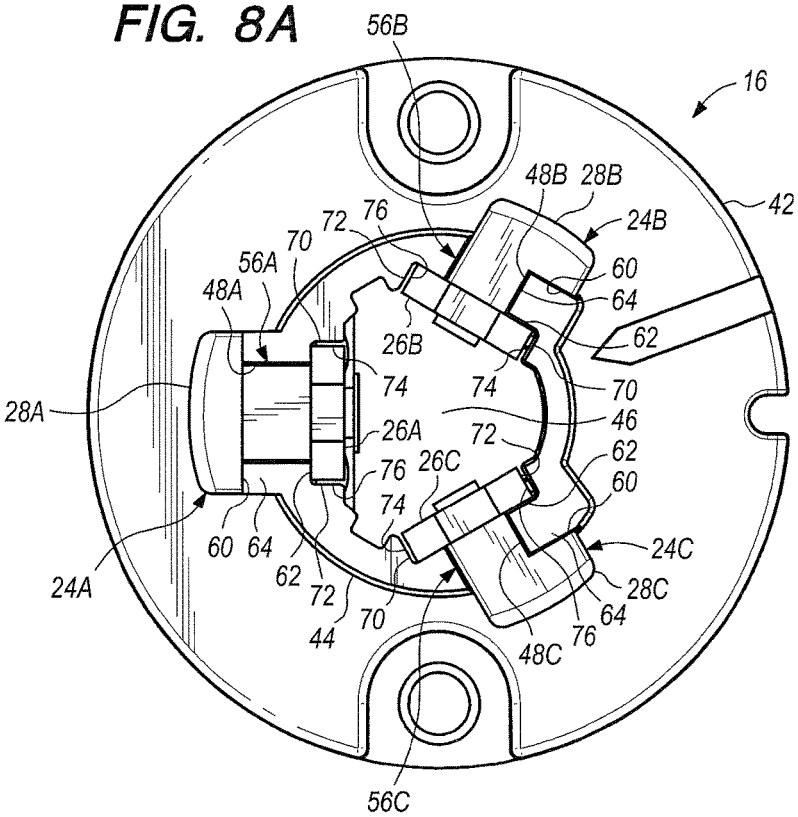
FIG. 8A is a view similar to FIG. 8, except depicting a top plan view of the subject matter thereof.

As can further be understood from FIGS. 1 and 8A, the electrical apparatus 14 includes a plurality of conductors that are indicated at the numerals 24A, 24B, and 24C, and which may be collectively or individually referred to herein with the numeral 24. The conductors 24 may or may not be identical to one another depending upon the needs of the particular application, and in the depicted exemplary embodiment the conductors 24 are not identical to one another.

The conductors 24A, 24B, and 24C each include an elongated shank that is indicated at the numerals 26A, 26B, and 26C, respectively, and which may be collectively or individually referred to herein with the numeral 26. At a first end of each shank 26, the conductors 24A, 24B, and 24C further include a contact that is indicated at the numerals 28A, 28B, and 28C, respectively, which may be collectively or individually referred to herein with the numeral 28. At a second, opposite end of the shank 26, each conductor 24A, 24B, and 24C additionally includes a terminal indicated at the numeral 30A, 30B, and 30C, respectively, which may be collectively or individually referred to herein with the numeral 30. Each terminal 30 includes an indentation 32A, 32B, and 32C which may be collectively or individually referred to herein with the numeral 32. The terminals 30 each include a fastener 34 and a backing plate 36, with the fastener 34 including a threaded portion 38 and a head 40. The threaded portion 38 is receivable in a threaded hole formed in the backing plate 36 and extends through the indentation 32 on the corresponding conductor 24, such as is depicted generally in FIG. 10. When the threaded portion 38 is received in the corresponding indentation 32, the second end of the corresponding shank 26 is situated generally between the backing plate 36 and the head 40 to enable a wire of the electrical load 6 to be electrically connected with the corresponding conductor 24.

Figure 4:
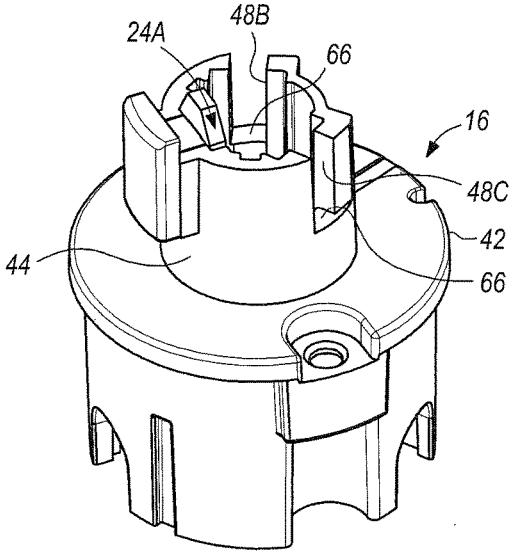
FIG. 4 is a perspective view of a first housing portion of the connection device of FIG. 1 having an electrode situated thereon.
Figure 6:
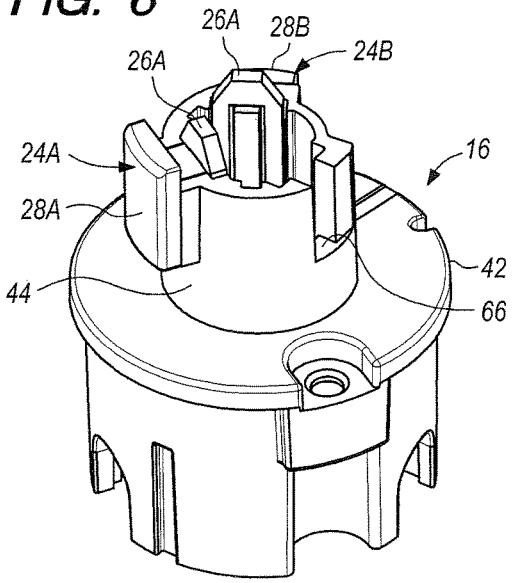
FIG. 6 is a view similar to FIG. 4, except depicting a pair of conductors mounted on the first housing portion.

As can be understood from FIGS. 1, 4, and 6, for example, the first housing portion 16 can be said to include a base 42 and a protrusion 44 situated thereon, and to further have an elongated channel 46 formed therein that extends longitudinally therethrough. The protrusion 44 has a plurality of notches 48A, 48B, and 48C formed in a first end thereof. The notches 48A, 48B, and 48C may be collectively or individually referred to herein with the numeral 48. The housing 12 can further be said to include a pair of fasteners 50A and 50B that are usable to connect together the first housing portion 16 with the fourth housing portion 22, as will be set forth in greater detail below.

As can be seen in FIG. 1, the second housing portion 18 can be said to have an elongated stem 52 and a cap 54, with the cap 54 being situated at an end of the stem 52. As will be set forth in greater detail below, the stem 52 is received in the channel 46 after the shanks 26 are received in the channel 46 and are situated on the first housing portion 16.

The connection device 4 can be said to further include a plurality of mounts 56A, 56B, and 56C, which may be collectively or individually referred to herein with the numeral 56. In the depicted exemplary embodiment, the mounts 56 each include a portion of the first housing portion 16 and further each include a portion of a corresponding one of the conductors 24. The mounts 56 are used to mount the conductors 24 to the first housing portion 16 prior to assembly of the other portions of the housing 12 to the first housing portion 16. In the depicted exemplary embodiment, each mount 56 includes a pair of confronting retention surfaces 60 and 62 that are formed on a corresponding contact 28 of a corresponding conductor 24. In the depicted exemplary embodiment, each mount 56 further includes a captive portion 64 (FIG. 8A) that is a part of the first housing portion 16 situated in the vicinity of a corresponding one of the notches 48. It is understood that in other embodiments the pair of confronting retention surfaces could be formed on the first housing portion and the captive portion could be formed on the corresponding conductor without departing from the spirit of the disclosed and claimed concept.

Figure 5:
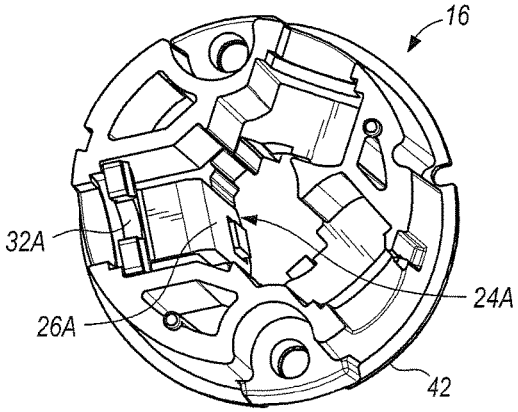
FIG. 5 is a view similar to FIG. 4, except from the underside of the first housing portion.
Figure 7:
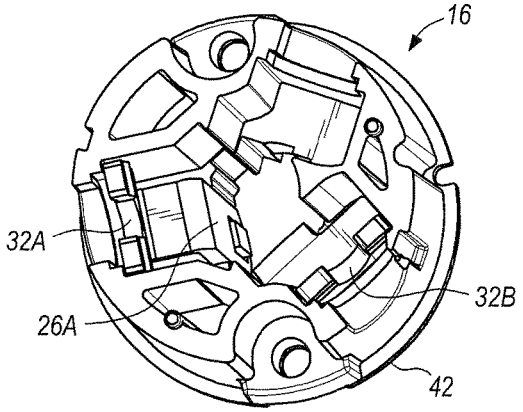
FIG. 7 is a view similar to FIG. 6, except from an underside of the first housing portion.

The connection device 4 is assembled by first receiving one of the conductors 24 on the first housing portion 16. In the depicted exemplary embodiment, this is done by receiving the conductor 24A on the first housing portion 16 such that its shank 26A is received in the channel 46 and its contact 28A is received in the notch 48A. The channel 46 is sized so that all three of the shanks 26A, 26B, and 26C can be simultaneously situated therein, except that the conductors 24A, 24B, and 24C must be individually received therein and mounted one at a time to the first housing portion 16. As such, after the conductor 24A is mounted to the first housing portion 16 as is depicted generally in FIGS. 4 and 5, the conductor 24B is mounted to the first housing portion 16 as is depicted generally in FIGS. 6 and 7. Likewise, and thereafter, the conductor 24C is mounted to the first housing portion 16 as is depicted generally in FIGS. 8 and 9.

As can be seen in FIG. 8A, when each conductor 24 is mounted to the first housing portion 16, the shank 26 is additionally received between a corresponding pair of abutments 70 and 72 that are a part of the first housing portion 16 and that are situated within the channel 46. The abutments 70 and 72 have a pair of opposed alignment surfaces 74 and 76, respectively, which engage the sides of the corresponding shank 26 and which resist movement of the conductor 24 in an azimuthal direction from the perspective of FIG. 8A. That is, the alignment surfaces 74 and 76 resist movement of the conductor 24 in an approximately circumferential direction generally transverse to a radius of the protrusion 44.

Figure 9:
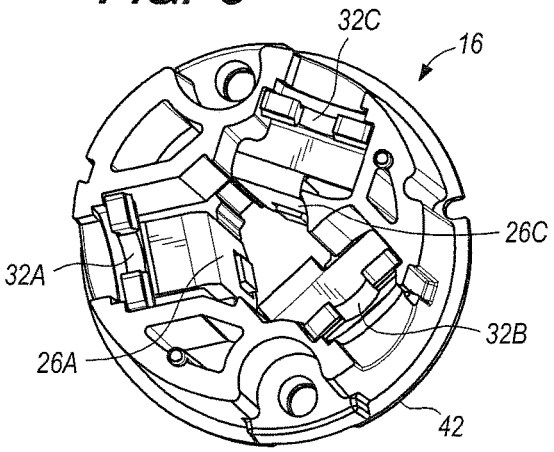
FIG. 9 is a view similar to FIG. 8, except from an underside of the first housing portion.

With the contacts 28 being received in the notch 48, such as is depicted generally in FIG. 8, the captive portions 64 of the protrusion 44 in the vicinity of the notches 48 are interposed between the corresponding retention surfaces 60 and 62 as can be seen generally in FIG. 8A. Such a relationship resists movement of the conductor 24A in a radial direction from the perspective of FIG. 8A, which is a direction generally orthogonal to the aforementioned azimuthal direction.

Figure 10:
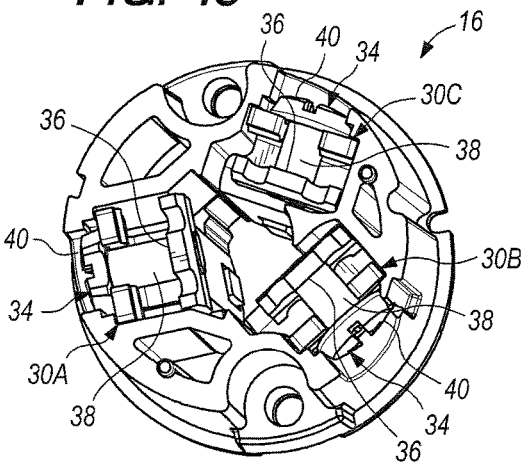
FIG. 10 is a view similar to FIG. 9, except additionally depicting screws and backing plates being situated on the three conductors to form terminals thereon.

When receiving the conductor 24A is in the position that is depicted generally in FIG. 4, the contact 28A is first aligned with the notch 48A, and the shank 26A is received between the corresponding abutments 70 and 72. The conductor 24A is then translating along the longitudinal extent of the channel 46 to receive the captive portion 64 between the retention surface 60 and 62. This is repeated for the conductors 24B and 24C. The fasteners 34 and backing plates 36 can be mounted to the indentations 32, as is depicted in FIG. 10, at any time after the corresponding conductor 24 is situated on the first housing portion 16 but prior to the attachment of the third housing portion 20 together with the second housing portion 18 that will be described in greater detail below. With the conductors 24 mounted to the first housing portion 16 in a fashion such as is depicted generally in FIGS. 8, 8A, and 9, the second housing portion 18 can then be received on the first housing portion 16 such as is depicted generally in FIG. 11. This is done by receiving the stem 52 in the channel 46 such that the shanks 26 are interposed between the stem 52 and the first housing portion 16 within the channel 46. The reception of the second housing portion 18 on the first housing portion 16 in such a fashion causes the cap 54 to be received against the free end of the protrusion 44 generally where the notches 48 are formed. In this regard, it can be seen that the base of each notch 48 can be said to form a first engagement surface 66 (FIG. 4), and the cap 54 can be said to form a number of corresponding second engagement surfaces 68 that are opposed to the first engagement surfaces 66. The expression "a number of" and variations thereof shall refer broadly to any non-zero quantity, including a quantity of one.

Figure 11:
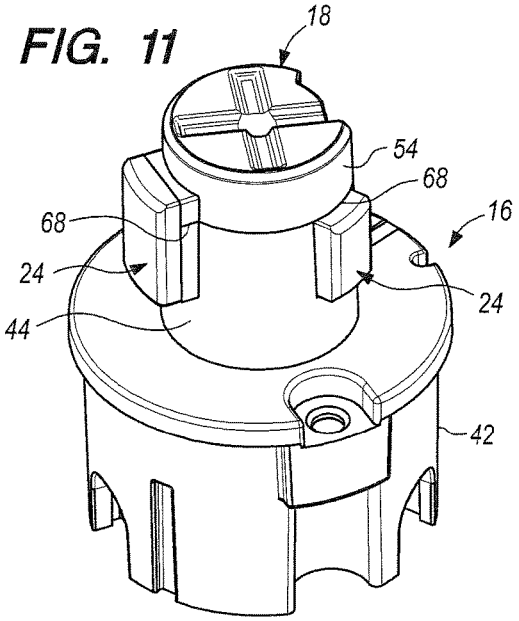
FIG. 11 is a view similar to FIG. 8, except additionally depicting a second housing portion received on the first housing portion.

The opposition of the first and second engagement surfaces 66 and 68 to one another retains the corresponding contacts 28 therebetween when the second housing portion 18 is received on the first housing portion 16, such as is depicted generally in FIG. 11. The reception of the contacts 28 between the first and second engagement surfaces 66 and 68 resists movement of the conductors 24 in a direction parallel with the longitudinal extent of the channel 46, i.e., which resists direction in the up-down direction from the perspective of FIG. 10, and such direction is generally orthogonal to the aforementioned azimuthal and radial directions. The various retention surfaces and structures that are formed on the housing 12 and the electrical apparatus 14 thus advantageously resist movement of the conductors 24 in three mutually orthogonal directions with respect to the housing 12, thus affixing the conductors 24 to the housing 12.

Figure 12:
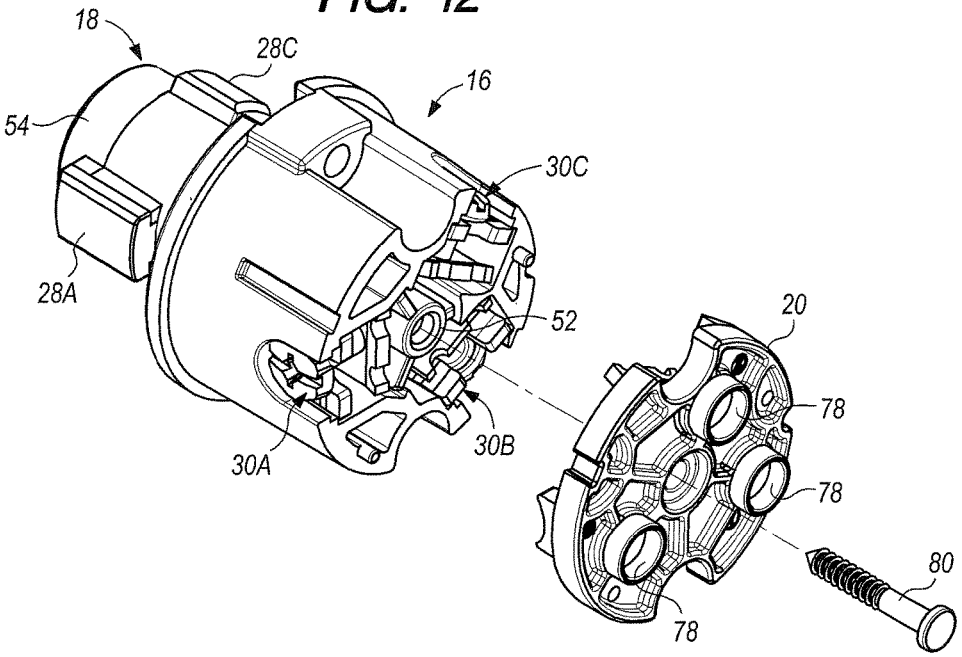
FIG. 12 is a view depicting a third housing portion being connected together with the second housing portion with the use of a fastener.

The third housing portion 20 can be mounted to the second housing portion 18, as is indicated generally in FIG. 12, with the use of a fastener 80. That is, the fastener 80 is used to affix the second and third housing portions 18 and 20 together, with the first housing portion 16 being generally interposed between the cap 54 and the third housing portion 20. As can be seen in FIG. 12, the third housing portion 20 includes a plurality of openings 78 formed therein through which wires or other such conductors that are electrically connected with the electrical load 6 can be received for connection with the terminals 30.

Figure 13:
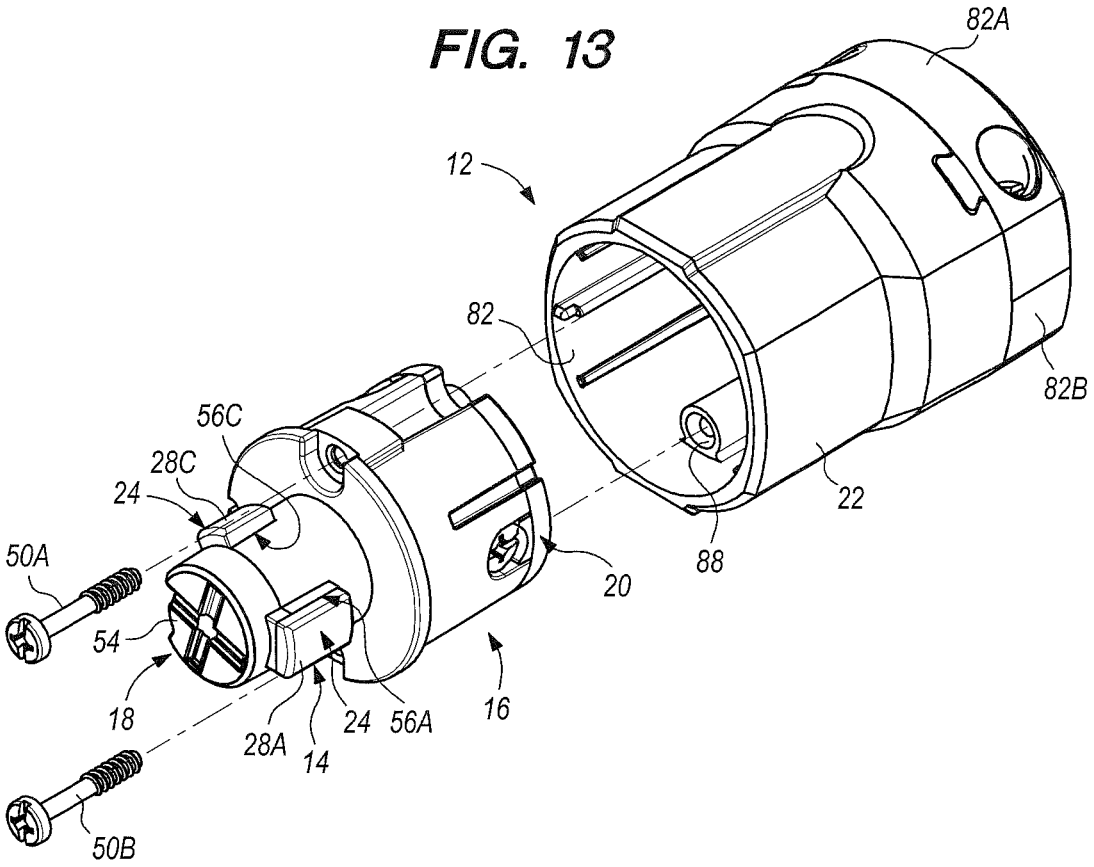
FIG. 13 is a view of the connected-together first, second, and third housing portions with the three conductors disposed thereon being received in a receptacle of a fourth housing portion.

As can be understood from FIG. 13, the assembled first, second, and third housing portions 16, 18, and 20 and the electrical apparatus 14 situated thereon can then be received in a receptacle 82 formed in the fourth housing portion 22. The base 42 receives therethrough the fasteners 50A and 50B for connection with corresponding threaded seats 88 that are formed on the fourth housing portion 22 within the receptacle 82. The fourth housing portion 22 includes a pair of compression elements 82A and 82B that are compressible toward one another with a pair of fasteners 86 that are usable to compress the power cord of the electrical load 6 therebetween after the wires of the power cord have been received through the openings 78 in the third housing portion 20 and electrically connected with the terminals 30.

It thus can be seen that the connection device 4 is formed of a housing 12 that includes a plurality of separately formed housing portions that are assembled together, along with the electrical apparatus 14, to form the connection device 4. The connection device 4 thus does not require the type of reworking that is required of molded connection devices such as was known to be necessary with molded connection devices, and it also advantageously does not have the rate of rejection that such molded connection devices had. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A connection device structured to be electrically connected with an electrical load and further structured to be electrically connected with a connector that includes a source of electrical power, the connection device comprising:

a housing comprising a first housing portion and a second housing portion that are separate from one another;

an electrical apparatus situated on the housing and comprising a plurality of conductors; and a number of mounts, at least a first mount of the number of mounts comprising a pair of confronting retention surfaces situated on one of the housing and a conductor of the plurality of conductors and further comprising a captive portion situated on the other of the housing and the conductor, the captive portion being received between the pair of confronting retention surfaces to resist movement of the conductor in a direction away from the housing;

wherein the first housing portion has an elongated channel formed therein, the second housing portion comprising a stem and a can, at least a portion of the stem being received in the channel, and the cap being situated adjacent an end of the first housing portion; and wherein the housing comprises a third housing portion separate from the first housing portion and the second housing portion and situated adjacent another end of the first housing portion opposite the end.

2. The connection device of claim 1 wherein each conductor of the plurality of conductors comprises an elongated shank, a contact, and a terminal, the contact being situated at a first end of the shank and being electrically connectable with the connector, the terminal being situated at a second end of the shank and being electrically connectable with the electrical load, at a least portion of each shank being situated in the channel and being disposed between the stem and the first housing portion.

3. The connection device of claim 2 wherein the at least first mount further comprising a first engagement surface formed on the first housing portion and a second engagement surface formed on the second housing portion, a portion of the conductor being retained between the first and second engagement surfaces to resist movement of the conductor in a direction along the longitudinal extent of the channel.

4. The connection device of claim 3 wherein the second engagement surface is situated on the cap.

5. The connection device of claim 3 wherein each shank has an indentation formed in the second end, and wherein the terminal comprises a fastener and a backing plate, the fastener comprising a threaded portion that is cooperable with the backing plate, the threaded portion being received in the indentation, the third housing portion being situated adjacent the second ends.

6. The connection device of claim 5 wherein the second housing portion and the third housing portion are affixable together to retain the first housing portion and the plurality of conductors situated therebetween.

7. The connection device of claim 5 wherein the fastener further comprises a head situated on the threaded portion, a portion of the shank having the indentation formed therein being situated generally between the head and the backing plate.

8. The connection device of claim 5 wherein the third housing portion has formed therein a plurality of openings adjacent the second ends that are structured to receive therethrough a plurality of wires that extend to the electrical load.

9. The connection device of claim 3 wherein the housing comprises a fourth housing portion separate from the first housing portion, the second housing, and the portion third housing portion, the fourth housing portion having formed therein a receptacle within which the third housing portion and at least a part of the first housing portion are situated.

10. A connection device structured to be electrically connected with an electrical load and further structured to be electrically connected with a connector that includes a source of electrical power, the connection device comprising:

a housing comprising a first housing portion and a second housing portion that are separate from one another;

an electrical apparatus situated on the housing and comprising a plurality of conductors; and a number of mounts, at least a first mount of the number of mounts comprising a pair of confronting retention surfaces situated on one of the housing and a conductor of the plurality of conductors and further comprising a captive portion situated on the other of the housing and the conductor, the captive portion being received between the pair of confronting retention surfaces to resist movement of the conductor in a direction away from the housing;

wherein the first housing portion has an elongated channel formed therein, the second housing portion comprising a stem and a cap, at least a portion of the stem being received in the channel, and the cap being situated adjacent an end of the first housing portion;

wherein each conductor of the plurality of conductors comprises an elongated shank, a contact and a terminal, the contact being situated at a first end of the shank and being electrically connectable with the connector, the terminal being situated at a second end of the shank and being electrically connectable with the electrical load, at a least portion of each shank being situated in the channel and being disposed between the stem and the first housing portion;

wherein the at least first mount further comprising a first engagement surface formed on the first housing portion and a second engagement surface formed on the second housing portion, a portion of the conductor being retained between the first and second engagement surfaces to resist movement of the conductor in a direction along the longitudinal extent of the channel; and wherein each conductor of the plurality of conductors has the pair of confronting retention surfaces situated thereon, and wherein the captive portion is a portion of the first housing portion.

11. The connection device of claim 10 wherein the number of mounts each further comprise a pair of abutments having a pair of alignment surfaces that are opposed to one another, the shank of the conductor being situated between the pair of alignment surfaces, the pair of alignment surfaces being structured to align the shank with the longitudinal extent of the channel.

12. A connection device structured to be electrically connected with an electrical load and further structured to be electrically connected with a connector that includes a source of electrical power, the connection device comprising:

a housing comprising a first housing portion and a second housing portion that are separate from one another;

an electrical apparatus situated on the housing and comprising a plurality of conductors; and a number of mounts, at least a first mount of the number of mounts comprising a pair of confronting retention surfaces situated on one of the housing and a conductor of the plurality of conductors and further comprising a captive portion situated on the other of the housing and the conductor, the captive portion being received between the pair of confronting retention surfaces to resist movement of the conductor in a direction away from the housing;

wherein the first housing portion has an elongated channel formed therein, the second housing portion comprising a stem and a cap, at least a portion of the stem being received in the channel, and the cap being situated adjacent an end of the first housing portion;

wherein each conductor of the plurality of conductors comprises an elongated shank, a contact, and a terminal, the contact being situated at a first end of the shank and being electrically connectable with the connector, the terminal being situated at a second end of the shank and being electrically connectable with the electrical load, at a least portion of each shank being situated in the channel and being disposed between the stem and the first housing portion;

wherein the at least first mount further comprising a first engagement surface formed on the first housing portion and a second engagement surface formed on the second housing portion, a portion of the conductor being retained between the first and second engagement surfaces to resist movement of the conductor in a direction along the longitudinal extent of the channel; and wherein:

the pair of confronting retention surfaces are situated on the conductor;

the first housing portion has a notch formed in an end thereof;

at least a portion of the conductor extends through the notch; and the captive portion is a portion of the first housing portion situated adjacent the notch.

* * * * *